United States Patent [19]

Beck, III

[11] Patent Number: 5,026,214

[45] Date of Patent: Jun. 25, 1991

[54] APPARATUS FOR PLACING CEMENTITIOUS MATERIALS IN EARTH EXCAVATIONS

[76] Inventor: August H. Beck, III, 206 Northcrest, San Antonio, Tex. 78213

[21] Appl. No.: 379,429

[22] Filed: Jul. 13, 1989

[51] Int. Cl.[5] ..... E02D 15/00

[52] U.S. Cl. ..... 405/240; 405/233; 405/248; 405/287

[58] Field of Search ..... 405/233, 239, 240–243, 405/248, 267, 269, 229; 222/527; 406/38–40, 164, 167

[56] References Cited

U.S. PATENT DOCUMENTS

| | | | |
|---|---|---|---|
| 1,831,209 | 11/1931 | Thornley et al. | 405/243 |
| 3,494,290 | 2/1970 | Schaible . | |
| 3,794,079 | 2/1974 | Fishel | 138/107 X |
| 3,856,095 | 12/1974 | Adair et al. | 175/203 |
| 4,152,089 | 5/1979 | Stannard | 405/242 |
| 4,180,350 | 12/1979 | Watts | 405/233 |
| 4,216,738 | 8/1980 | Muta . | |
| 4,229,122 | 10/1980 | Ballantyne | 405/240 X |
| 4,397,588 | 8/1983 | Goughnour | 405/233 X |
| 4,618,289 | 10/1986 | Federer | 405/233 X |
| 4,669,145 | 6/1987 | Kehr . | |
| 4,745,879 | 5/1988 | Shishkin et al. . | |

FOREIGN PATENT DOCUMENTS

| | | | |
|---|---|---|---|
| 470806 | 10/1914 | France | 405/242 |
| 33675 | 10/1912 | Sweden | 405/240 |

OTHER PUBLICATIONS

"Sidewinder Concrete Pumps," trade pamphlet distributed by Reed Inc. of Walnut, Calif., publication undated.

"Concrete Pumps and Placing Booms—Full Line," trade brochure distributed by Schwing America, Inc. of White Bear, Minn., publication date: Feb. 1983.

"Trailer-Mounted Concrete Pumps," trade brochure distributed by Schwing America, Inc. of White Bear, Minn., publication date: Feb. 1983.

"Concrete Pumping Services," trade brochure distributed by Hercules Concrete Pumping Service, Inc. of Dallas, Tex., publication date: 1983.

"Model BRA 1400," trade brochure distributed by American Pecco Corporation, publication undated.

*Primary Examiner*—Dennis L. Taylor
*Assistant Examiner*—John A. Ricci
*Attorney, Agent, or Firm*—Cox & Smith Incorporated

[57] ABSTRACT

A method and apparatus for placing cementitious material into an excavation using a mobile unit having an extendable flexible hose mounted on a power driven hose reel. Cementitious material is pumped through the hose and out the hose end into an excavation as the flexible hose is reeled out of the excavation. A weight at the end of the hose keeps the end of the hose from jetting itself about during the pumping operations. An extendable hose boom positions the end of hose over an excavation and directs the hose into the excavation and out during pumping.

7 Claims, 3 Drawing Sheets

APPARATUS FOR PLACING CEMENTITIOUS MATERIALS IN EARTH EXCAVATIONS

BACKGROUND OF THE INVENTION

This invention relates generally to placing cementitious material such as concrete in foundations. Foundations for buildings, bridges, and other structures can be constructed in several different ways. Two categories are shallow foundations and deep foundations. Examples of shallow foundations include mats and spread footings. Examples of deep foundations include driven piling made of either concrete or steel and drilled shaft methods. The present invention relates to the drilled shaft methods.

A piling may be a pre-cast or pre-fabricated member made of either steel or concrete that is driven with a hammer into the ground until it attains a certain refusal rate which indicates that the piling can support a certain load. Some soils are so hard or consolidated, however, that they may not readily accept a driven pile or the cost is greater than the drilled shaft method. Also, certain engineers may prefer one type of foundation system over others and surrounding conditions may make one type of foundation system preferable or necessary.

In the drilled shaft method, the shafts are drilled with foundation drilling equipment, which may comprise an attachment on a crane or a truck-mounted type of rotary. The rotary turns a Kelly-bar or drill-stem, which is attached to an auger or drill bucket or some other drilling bit, which excavates the hole. As the hole is drilled, the cuttings are brought to the surface and disposed on the ground. This process is continued until the shaft is excavated to the required depth.

Once the hole is drilled to the desired depth then a reinforcing cage is normally placed in the hole. The length of the steel may or may not extend to the full depth of the hole. Reinforcing cages are typically of a rebar type of construction, with spiral or circular hoops. Hoops and rebars are tied into a fabricated cage. The cage is then lifted up by a crane and placed in the hole. It either rests on the bottom or is suspended at the top of the hole by some method.

The drilled shaft method can be practiced several different ways. In one way called the dry method, an open hole is excavated and the sides of the shaft are self-supporting. The foundation material is then merely placed into the hole. Another method is the cased method, where a steel casing is used throughout the area of an unstable soil strata. The excavation may then proceed through and below the casing in most cases.

A third way of practicing the drilled shaft method is the wet hole or slurry-displacement method where the walls of the shaft are kept open and prevented from collapsing by use of a drilling fluid such as a bentonite slurry, atapulgate, a polymer solution, or water. These fluids exert a hydrostatic pressure to keep the hole or excavation from caving. Sometimes, water is present in the excavation not because of a need for caving prevention but because certain formation stratus communicate natural water into the excavation. In the slurry-displacement method, which is one method to which the present invention relates, ready-mix concrete is placed in the fluid filled excavation from the bottom up. A steel pipe called a tremie pipe is used to place the concrete into the hole.

A tremie pipe is usually a small-diameter pipe that extends from the top of the shaft or excavation to the bottom and through which concrete is poured from the top. A pig, or foam-rubber plug is often put in ahead of the concrete to push the water or other drilling fluid out of the pipe ahead of the concrete. The bottom of the tremie can also be temporarily plugged water tight and filled with concrete. The concrete has a specific gravity greater than the drilling fluid. As the concrete is poured, the fluid is displaced to the top. It either runs out of the excavation on the ground or pumped to a holding tank or pit for later reprocessing or disposal. To pour these shafts, a crane or other lifting apparatus is often used to hold the tremie pipe in the hole.

A tremie pipe may be made of sections about ten (10) feet long and of small-diameter casing in the order of ten (10) inches, each section having threaded ends. These threaded ends are screwed together until a tremie pipe of sufficient length to reach the bottom of the hole is produced. A hopper may be placed at the top of the tremie pipe for receiving concrete which then flows down the pipe. As the excavation is filled, the tremie is periodically raised and a joint is removed. The bottom of the tremie remains submerged in the fluid concrete.

In the case of a solid piece of tremie pipe, without any joints at 10-foot intervals such as earlier described, a concrete bucket or a concrete pump may be used to help elevate the concrete into the hopper once the tremie is raised up. In order to prevent the concrete, which becomes progressively more resistant to flow, from lifting the steel reinforcing cage up, the tremie pipe is raised as the concrete is placed. Thus, it may be necessary to use two cranes: one to the hold and raise the tremie pipe and another crane with a concrete bucket to deliver the concrete. A concrete pump boom truck may also be used to support the tremie pipe when the size and length of the tremie pipe permits.

SUMMARY OF THE INVENTION

It is an object of the present invention to provide a method and apparatus for placing cementitious material such as concrete into drilled shafts or other earthen excavations which eliminates the need for a crane to either help place the concrete into the tremie hopper or to raise the tremie pipe as material is poured.

Instead of using a hard, steel tremie pipe, the present method uses a flexible hose that is wound on a reel and lowered down into the hole. The flexible hose may have a weight on the end to cause the hose to drop down into the hole or excavation and help keep it positioned during the pumping and overcome any buoyant force. A boom is used to position the hose over the drilled shaft and guide the hose into the shaft as it is unreeled.

The present invention also allows an operator to continuously place the concrete into the shaft without having to stop to raise and remove sections of a tremie pipe. After each operation, the hose may be cleaned by forcing a pig through the hose with air pressure.

Other objects, features, and advantages of the invention will become evident in light of the following detailed description considered in conjunction with the referenced drawing of a preferred exemplary embodiment according to the present invention.

DETAILED DESCRIPTION OF THE PREFERRED EMBODIMENT

Figure 1:
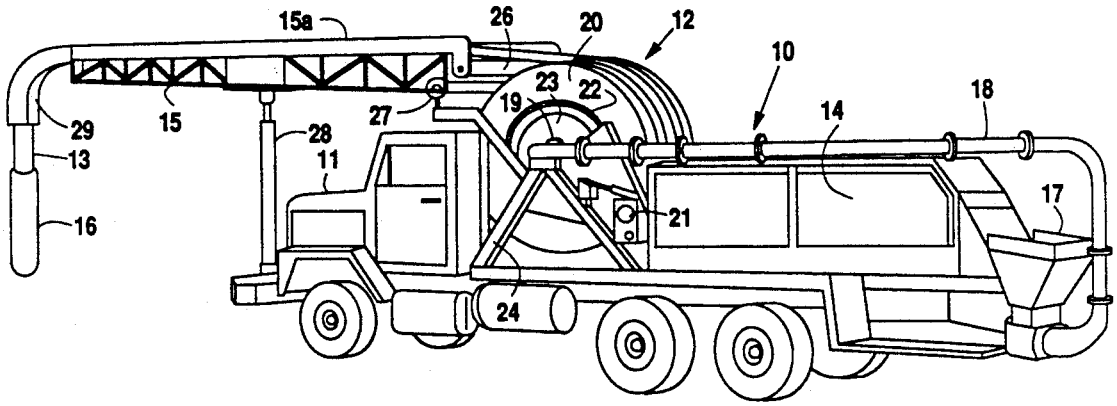
FIG. 1 of the drawing shows a perspective view of a first embodiment of the invention.

Referring to FIG. 1 of the drawings, there is shown a mobile unit 10. The mobile unit 10 may comprise a conventional truck 11. The truck 11 may be a heavy-duty truck capable of supporting the components of the invention. A trailer unit may also be used in place of the truck, which would require a separate tractor unit to position the unit at the work site and to haul it between work sites. The mobile unit 10 includes a power driven hose reel system 12 upon which is wound a large, flexible hose 13. A conventional concrete pump 14 may be mounted on the mobile unit and a hose boom 15 may be similarly mounted on the mobile unit. A weight 16 may be attached to the end of the hose 13. The weight could be made of heavy wall pipe and could act as an extension of the hose. The weight 16 helps keep the hose 13 from jetting itself about during pumping. The weight also offsets buoyant forces which might prevent the hose from reaching the bottom of the excavation. The weight also aids in pulling the hose off the reel when lowering into excavation and helps hold the hose steady when concrete is being pumped with a piston pump which may cause pulsating, surging, or jetting up of the hose.

Figure 2:
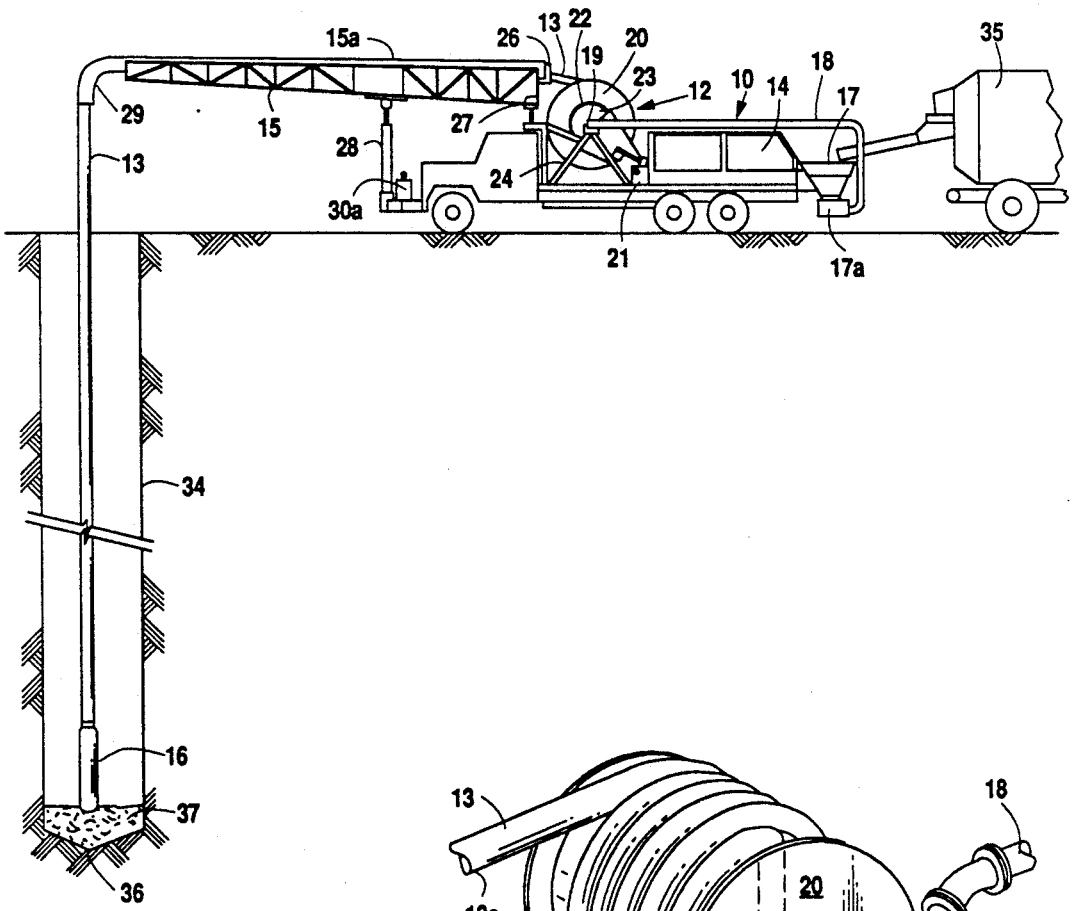
FIG. 2 shows a side elevation view of the first embodiment with the hose lowered into a drill shaft or excavation and a conventional concrete truck pouring concrete into the concrete pump used with the first embodiment.
Figure 3:
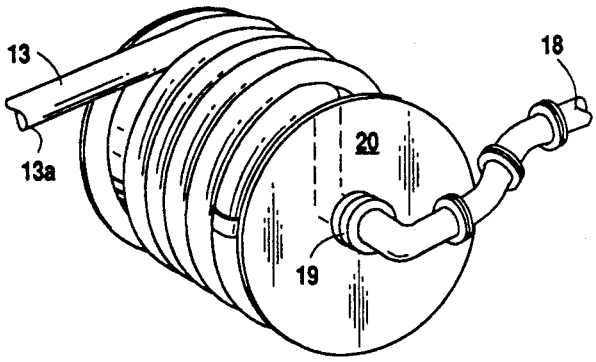
FIG. 3 shows a partial view of the hose reel.

As shown in FIGS. 1, 2, 4 and 5, the concrete pump 14 includes a concrete receiving hopper 17 and supplies concrete through concrete suppyly line 18. The concrete supply line 18 is connected through a rotary seal 19 as best shown in FIG. 3 to the flexible hose 13 which is wound upon the reel 20. As shown in FIGS. 1, 2, and 3, a hydraulically driven reel motor 21 is provided to supply power to the reel 20 through drive chain 22. The rotary seal allows the reel 20 to rotate yet still maintain the fluid connection with the stationary concrete supply line 18. The hydraulically driven reel motor 21 comprises a hydraulic motor that is connected to the reel 20 through a drive chain 22. This type of reel motor and drive chain is similar to the type used on conventional ready-mix concrete trucks to rotate the concrete mixing drum. The drive chain 22 drives a reel drive sprocket 23 which is connected to the reel 20. A gear box could be used to connect the motor to the reel with a direct shaft connector. The cylindrical reel 20 is rotatably mounted upon a reel stand 24 which is secured to the frame of the truck 11.

Figure 4:
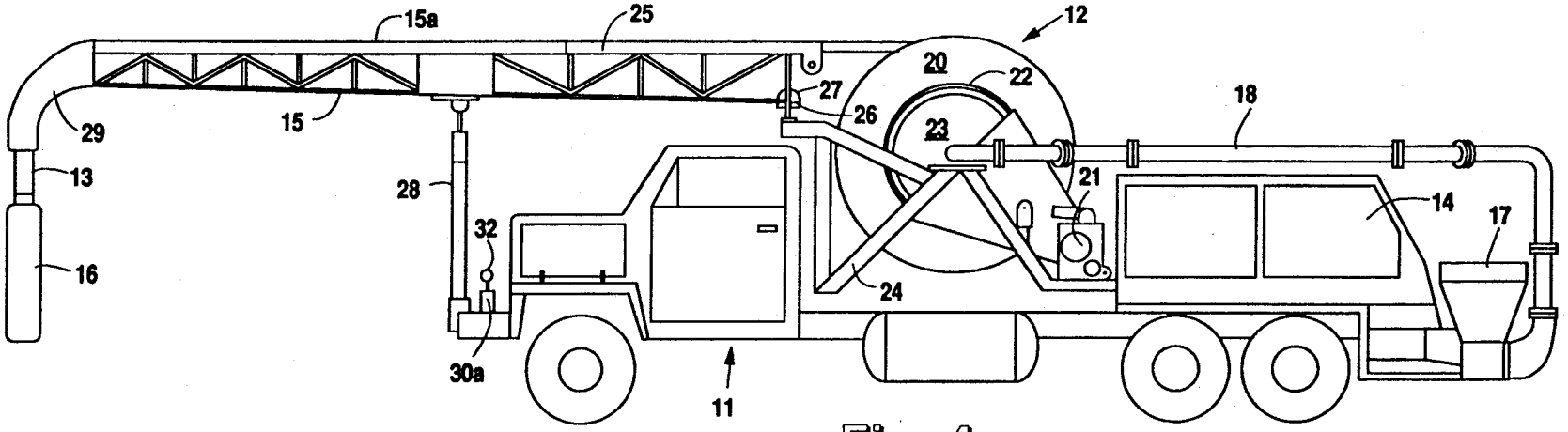
FIG. 4 shows a side elevation view of the first embodiment.
Figure 5:
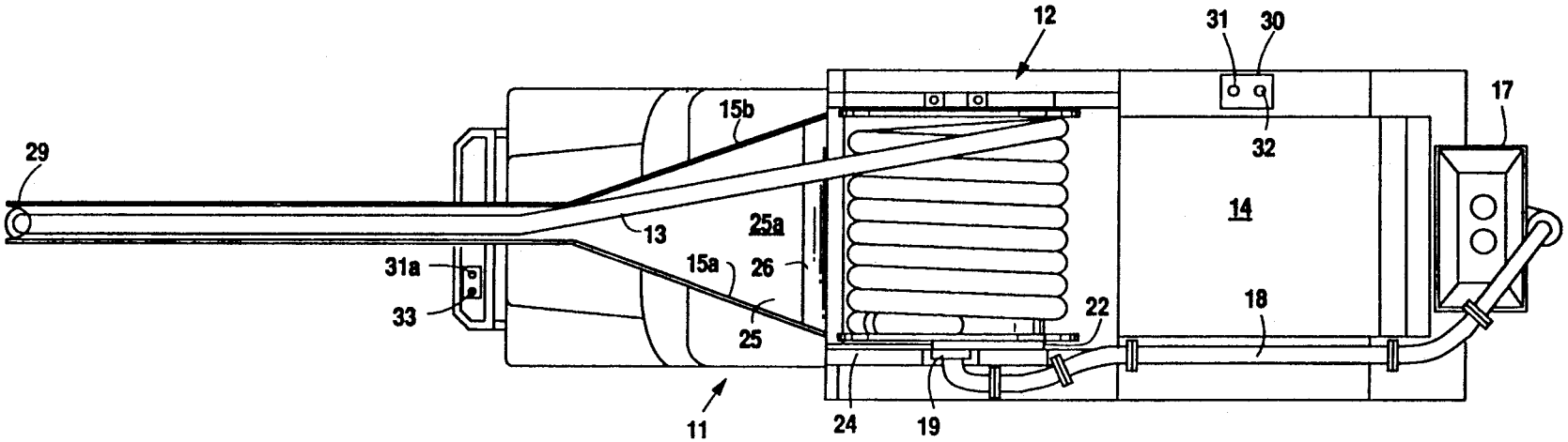
FIG. 5 shows a top view of the first embodiment.

At the upper end of the reel stand 24, as shown in FIGS. 1, 2, and 4, there is a pivot connection 27 through which the boom 15 is pivotally connected to the reel stand. This allows the boom to be raised up and down using support and elevating cylinder 28. The boom 15 includes a boom tray 25 having a flat hose slide surface **25*a* as in FIGS. 4 and 5. The boom tray surface 25*a* may typically be lined with stainless steel or other hard smooth lining and is a flat surface which carries the hose 13. A roller 26 is rotatably mounted to the boom 25 adjacent the reel 20 to aid in level winding the hose 13. As shown in FIG. 5 vertical side members 15*a* and 15*b* maintain the hose 13 on the flat tray 25. At the end of the boom 15 is a radius boom end 29 which directs the hose 13** downwardly.

The operation of the mobile unit 10 is as follows. In the case of the truck 11, the driver positions the weight 16 at the end of hose 13 over an excavation into which cementitious material is to be placed. The cylinder 28 may be extended or retracted to raise and lower the boom 15 to the desired location. At the rear of the truck as shown in FIG. 5 there is a rear control 30. The rear control 30 includes reel rotational direction control 31 and hydraulic pump speed control 32. The hydraulic pump speed controls the hydraulic pump which supplies hydraulic fluid to the hydraulically driven motor 21 and controls its speed and ability to lift and lower the hose 13 with weight 16 at its end. At the front of the truck is the front control **30*a*. The front control 30*a* also includes a reel rotational direction control 31*a*. It also includes an elevating cylinder control 33. The conventional controls for the concrete pump 14 are not shown. Similar controls may also be located in the cab of the truck 11** when desired.

As shown in FIG. 2, the mobile unit 10 is positioned in proximity to an excavation 34 which is typically filled with fluid to prevent cave-ins. The fluid may take the form of drilling slurry or mud, which is well known in the art, or in some cases may be water. Water in the excavation could also be present because the soil stratus encountered could communicate the natural water table into the excavation. The weight 16 and hose 13 are shown lowered into the excavation 34 in the earth. The weight 16 would be lowered close to the bottom 36 of the excavation. Cementitious material 37 from a concrete supply truck 35 would then be pumped through the supply line 18. The concrete supply truck 35 dumps the cementitious material into the hopper 17, which is pumped through supply line 18 to the reel 20. The concrete flows through the rotary seal 19 which allows rotation of the reel while maintaining the fluid connection and then flows through the hose 13 and out through a cylindrical opening at the bottom of the weight 16. The end of the weight 16 may include a seal means to prevent the fluid in the excavation from traveling up the hose as it is lowered in place. Alternatively, a conventional pig or plug may be pumped through the hose 13 ahead of the concrete to clear out any fluid that enters it when the hose and weight are lowered into the excavation.

In practice, the cementitious material 37 would be pumped below the fluid in the excavation which would cause the fluid to rise since the fluid is of less specific gravity. During operation, the hose 13 would be lifted out of the excavation by reeling it up on the reel 20. The weight and the hose would be maintained imbedded a certain distance in the cementitious material. Typically an operator would be positioned above the excavation and would continually monitor the depth of the concrete by dropping down a measuring tape with weighted end through the fluid until the weight came into contact with the heavier concrete. This way one could continuously monitor the depth of the cementitious material as it displaces the fluid. Although not shown, typically a mud or fluid pump would be placed at the top of the excavation 34 to pump the displaced fluid into receiving tanks or a receiving pit where the material would either be stored or cleaned for additional use.

Unlike some prior art methods, it is unnecessary to have a crane to support a long tremie pipe. Nor is it necesary to have a crane to bucket concrete to the top of the tremie pipe through which concrete is poured. Furthermore it is not necessary to stop operations to remove sections of the tremie pipe since the hose 13 may be continuously reeled upwardly as concrete is supplied through it to fill the excavation and displace fluid from the excavation.

At the end of the job or at any time concrete operations are ceased it is necessary to clean the concrete from the hose 13 which acts as the tremie pipe. With tremie pipes, it is necessary to pour sufficient water down the tremie pipe to clean out the concrete. In the present invention, one can use compressed air to force a pig or plug through the concrete pumping system, including the hose 13, to force out the concrete contained therein. Then a smaller amount of water can be utilized to finally clean the system. This reduces the amount of water necessary which reduces the amount of mess and clean up labor needed afterwards.

It is understood that a suitable metal or steel reinforcing cage could be positioned in the excavation 34. Typically this cage would be positioned in the excavation with the fluid in place and would remain in place as the concrete displaces the drilling fluid and surrounds the cage. The cage may typically be rebar or other types of steel reinforcing material that is fabricated at the site and lowered into the excavation. It is understood that the cage may extend the full length of the excavation or may only be extended partially through the excavation.

The excavation can take the form of a cylindrical drilled hole or may also take the form of a trench. These types of excavations are known in the construction industry and are used in appropriate applications. Conventional methods would be used to excavate the trench. The concreting operation would be similar to that previously described.

The invention may also be used in dry-hole construction since some specifications limit the amount of free fall that concrete can have. In this situation the method would be similar except the weight 16 would be lowered to the bottom of a dry hole. In this situation, the bottom of the weight 16 would be maintained above the concrete not to exceed the maximum free fall permitted.

The hose 13 may also include a companion support cable 13*a* to help support the flexible hose. Since the weight 16 and concrete in the hose 13 may weight over one thousand pounds, considerable pulling forces may be exerted on the hose. Accordingly it is preferable to support the hose primarily through a support cable 13*a*. The hose support cable 13*a* is connected to the end of the hose at the reel 20 and is similarly connected to the weight 16 to support most of the weight. The cable 13*a* could also be held next to the hose with connectors at spaced intervals all along the length of the hose.

Figure 6:
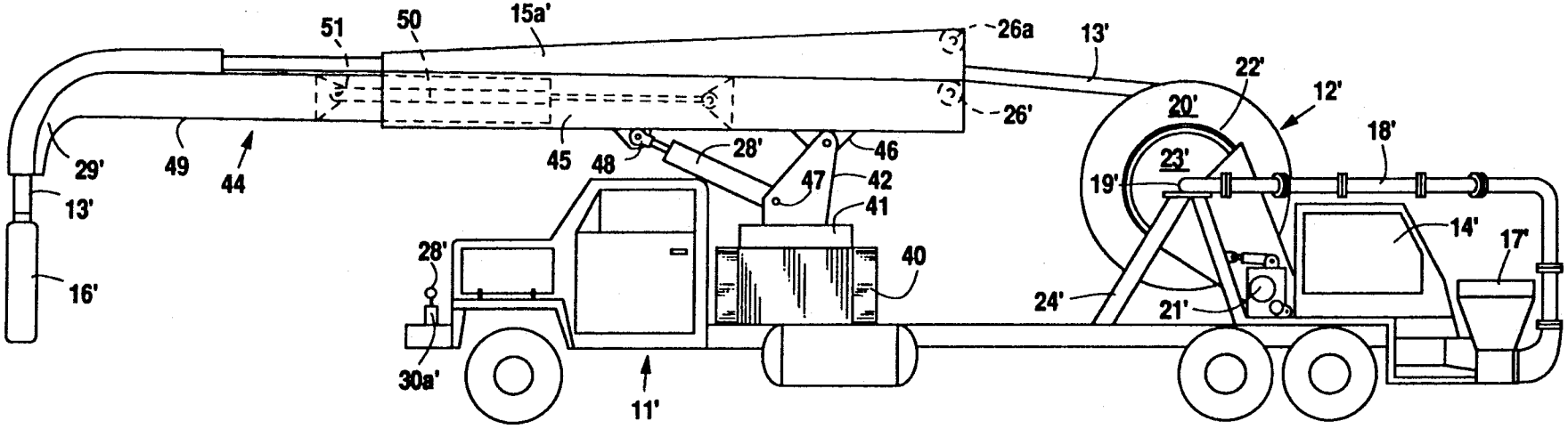
FIG. 6 shows a side elevation view of a second embodiment of the invention.
Figure 7:
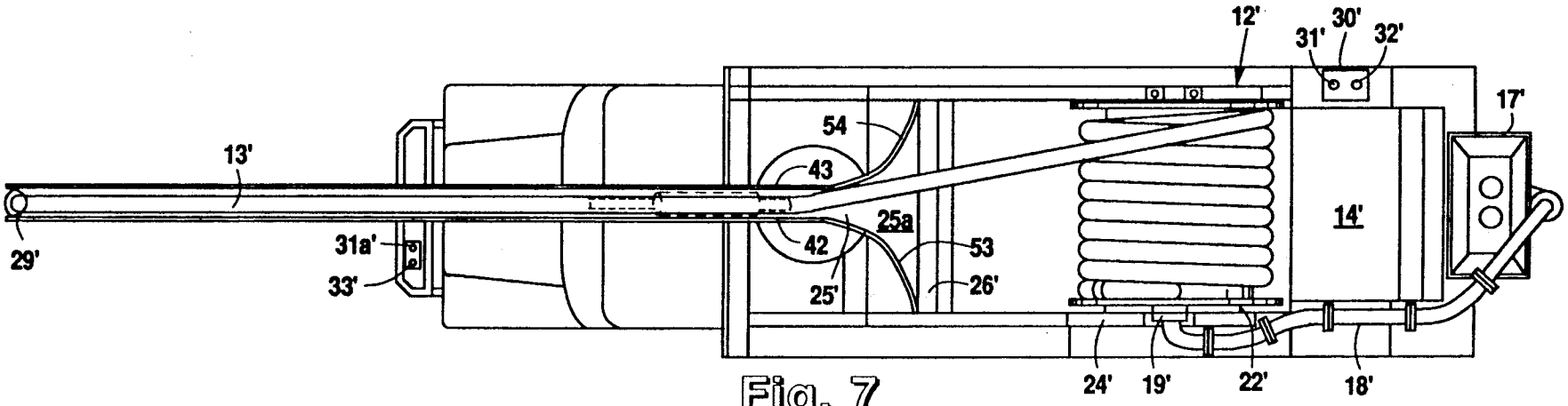
FIG. 7 shows a top view of the second embodiment.

Referring to FIGS. 6 and 7 of the drawing, there is shown another embodiment of the invention. The second embodiment has numerous similarities with the first embodiment shown in FIGS. 1–5. Because of the similarities, equivalent or identical components are given the same reference numeral with the addition of a "′" superscript. The operation of the embodiment shown in FIGS. 6 and 7 is essentially identical to the operation of the embodiment shown in FIGS. 1–5 with the following exceptions.

The device shown in FIGS. 6–7 includes a rotating turntable mount 40 which is secured to the frame of truck 11′. A hydraulically driven motor is mounted within the rotating turntable mount 40 and is operatively connected through a gear box to turntable 41 which is rotatably mounted upon the turntable mount 40. A pair of spaced supports 42 and 43 support telescoping boom 44. The telescoping boom 44 includes a first box section 45 which includes a pivot mount 46 as shown in FIG. 7. Hydraulic cylinder 28′ is pivotally connected at pivot point 47 to the spaced supports 42 and 43 and is similarly pivotally connected to mount 48 which is connected to the first box section 45 of the telescoping boom. A second boom telescoping section 49 is mounted to extendably slide within the first box section 45 and telescopes therein of actuation of hydraulic cylinder 50 which is connected at point 51 to the second box section and point 52 to the first box section. Retraction and extension of the hydraulic cylinder 50 results in retraction and extension of the second box section 49 within the first box section 45 and controls the length of the boom. This allows the second box section to be retracted within the first box section such that the weight 16′ is closer to the front of the vehicle and such that the boom may extend a large distance in front of the vehicle. It also enables the weight 16′ to be extended to a desired location above a pour point which extended distance may make transport of the truck 11 difficult. Also, it may not be possible to always position the truck 11 the same distance from the pour point. Although only two telescoping sections are illustrated, more sections could be used when needed.

As will be apparent, the boom 44 may be raised and lowered with the hydraulic cylinder 28′ in a manner similar to the embodiment shown in FIGS. 1–4. The turntable 41 may be selectively rotated by actuating its hydraulic drive such that the weight 16′ can be positioned at the sides of the vehicle to facilitate pouring.

As previously described, a radius bend 29′ is provided to give proper bend radius for the hose. This radius bend may be in the order of three feet. Similar radius bends on vertical side members 53 and 54 are provided at the top of the tray 25A′ to maintain proper bend radius of the hose when the turntable 41 is rotated to the side to position the weight 16′ above a pour point. An additional roller 26A is provided to maintain the hose 13′ on the tray 25A′. It is understood that suitable outriggers, counterweights, or counterbalances could be utilized to balance the system.

As will be apparent, the embodiment shown in FIGS. 6 and 7 has the advantage of allowing positioning of the weight 16′ further away from the vehicle 11′ when it is desired to reach a more remote pour point and to allow the boom to be retracted for transport. Furthermore, the turntable 41 allows movement of the weight 16′ to each side of the vehicle 11′ to reach pour points which can be accessed more conveniently from the side of the vehicle.

The reel system 12′ is essentially the same as the reel system 12 shown in FIGS. 1–5. The concrete pump 14′ is slightly different in profile mounting but is identical in function to the concrete pump 14.

Other objects, features, and advantages of the invention will become evident in light of the following detailed description considered in conjunction with the referenced drawing of a preferred exemplary embodiment according to the present invention.

I claim:

1. A mobile apparatus for placing cementitious material into a construction excavation comprising:

a reel mounted flexible hose means for connecting to a cementitious material pump and for extending a hose mounted thereon into and out of a construction excavation;

an elongate boom for supporting said hose means and guiding said hose means in a substantially linear path along the length of said boom between proximal and distal ends thereof, said boom being pivotally connected at a pivot point to a frame and extending from said frame for positioning the distal end of the boom above a pour point of the construction excavation, said distal end further having a radius bend for directing the hose downwardly from a distal end of said boom;

means for pivoting said boom relative to said pivot point in a vertical plane for raising and lowering the distal end of said boom to position the distal end over the construction excavation pour point; and weight means on the end of the hose to cause the hose end to sink to the bottom of the construction excavation pour point so that cementitious material pumped through the hose will fill the construction excavation with cementitious material and the hose will remain in a desired position.

2. The apparatus as set forth in claim 1 comprising:

a cementitious material pump.

3. The apparatus as set forth in claim 1 comprising:

a mobile unit for supporting the reel mounted flexible hose, boom, and weight means.

4. The apparatus as set forth in claim 1, further comprising:

control means for positioning a boom and for extending the hose into and out of the construction excavation pour point.

5. The apparatus as set forth in claim 1, comprising:

means for extending and retracting the boom to position it at a desired location.

6. The apparatus as set forth in claim 1, comprising:

means for swinging the boom from side to side to position it at a desired location.

7. The apparatus as set forth in claim 1, further comprising:

a support cable for supporting the weight means and hose.

* * * * *